US011459682B2

(12) United States Patent
An et al.

(10) Patent No.: US 11,459,682 B2
(45) Date of Patent: Oct. 4, 2022

(54) MACHINE FOR TREATING LAUNDRY INCLUDING SHOES

(71) Applicant: LG Electronics Inc., Seoul (KR)

(72) Inventors: Seongwoo An, Seoul (KR); Minkyu Oh, Seoul (KR); Yongnam Kim, Seoul (KR); Yanghwan No, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/452,215

(22) Filed: Jun. 25, 2019

(65) Prior Publication Data

US 2019/0387954 A1 Dec. 26, 2019

(30) Foreign Application Priority Data

Jun. 26, 2018 (KR) ..... 10-2018-0073521

(51) Int. Cl.
*A47L 23/02* (2006.01)
*D06F 31/00* (2006.01)
*D06F 39/14* (2006.01)

(52) U.S. Cl.
CPC ..... *D06F 31/00* (2013.01); *A47L 23/02* (2013.01); *D06F 39/14* (2013.01)

(58) Field of Classification Search
CPC ..... D06F 29/00; D06F 29/005; D06F 31/00; D06F 39/14; A47L 23/02
See application file for complete search history.

(56) References Cited

U.S. PATENT DOCUMENTS 5,418,996 A * 5/1995 Chen ..... A47L 23/02 15/36
2011/0265524 A1* 11/2011 Kim ..... D06F 29/00 68/13 R
2015/0211164 A1 7/2015 Kim et al.
(Continued)

FOREIGN PATENT DOCUMENTS

CN 201324223 10/2009
CN 103710940 A * 4/2014
(Continued)

OTHER PUBLICATIONS

Extended European Search Report in European Application No. 19175999.2, dated Oct. 2, 2019, 9 pages.
(Continued)

*Primary Examiner* — Joseph L. Perrin
*Assistant Examiner* — Irina Graf
(74) *Attorney, Agent, or Firm* — Fish & Richardson P.C.

(57) ABSTRACT

A machine for managing laundry includes a first washing part including a first washing body and a first door, where the first washing part has a first washing capacity, a second washing part including a second washing body and a second door, where the second washing part has a second washing capacity that is less than the first washing capacity, and a third washing part including a third washing body and a third door, where the third washing part has a third washing capacity that is less than the first washing capacity. The third washing part includes a shoe mount configured to support one or more shoes. The first washing part, the second washing part, and the third washing part are configured to be stacked in a vertical direction.

20 Claims, 10 Drawing Sheets

(56) References Cited

U.S. PATENT DOCUMENTS

| | | | | |
|---|---|---|---|---|
| 2015/0259844 | A1* | 9/2015 | Doyle | A47B 88/40 68/17 R |
| 2018/0087197 | A1 | 3/2018 | Matos | |
| 2018/0340285 | A1 | 11/2018 | Choi et al. | |

FOREIGN PATENT DOCUMENTS

| | | | | | |
|---|---|---|---|---|---|
| CN | 104805636 | A | * | 7/2015 | |
| CN | 104947367 | A | * | 9/2015 | |
| CN | 204702964 | | | 10/2015 | |
| CN | 105476586 | A | * | 4/2016 | |
| CN | 105624993 | A | * | 6/2016 | |
| CN | 106691354 | A | * | 5/2017 | |
| CN | 206880649 | | | 1/2018 | |
| CN | 107761306 | A | * | 3/2018 | |
| CN | 107805909 | A | * | 3/2018 | |
| CN | 207101247 | | | 3/2018 | |
| DE | 202004010585 | | | 9/2004 | |
| KR | 100802063 | B1 | * | 2/2008 | |
| WO | WO2015143912 | | | 10/2015 | |
| WO | WO2017003170 | | | 1/2017 | |
| WO | WO-2017059817 | A1 | * | 4/2017 | A47L 23/02 |
| WO | WO-2018059538 | A1 | * | 4/2018 | A47L 23/00 |

OTHER PUBLICATIONS

Chinese Office Action in CN Appln. No. 201910461366.1, dated Jan. 28, 2021, 15 pages (with English translation).

* cited by examiner

MACHINE FOR TREATING LAUNDRY INCLUDING SHOES

CROSS-REFERENCE TO RELATED APPLICATIONS

The present application claims priority under 35 U.S.C. 119 and 35 U.S.C. 365 to Korean Patent Application No. 10-2018-0073521, filed on Jun. 26, 2018, which is hereby incorporated by reference in its entirety.

TECHNICAL FIELD

The present disclosure relates to a machine for managing laundry.

BACKGROUND

Machines for managing laundry may include devices that can perform various operations such as washing, dehydrating, and/or drying. For example, machines for managing laundry may include devices that can supply water to immerse laundry in the water and that can remove dirt stained on the laundry by detergent in washing water.

In some examples, the machine for managing laundry may include a washing machine that can wash laundry such as clothing, bedding, and the like based on an emulsifying action of a detergent, a water flow generated by rotation of a washing tub or a washing blade, and mechanical force applied by the washing blade, a dryer that can apply hot air or cold air to laundry to dry the laundry, and a refresher that can apply steam to clothes to remove wrinkles of the clothes. In some cases, the machine for managing the laundry may be a combination device providing a number of functions such as a washing machine with a dryer.

In some examples, a minimum amount of washing water for performing washing may be supplied to the machine for managing laundry. If a washing tub has a large capacity, a large amount of washing water may be required to wash a small amount of laundry. In some cases, a mini washing machine or a washing machine for baby clothes may wash a small amount of laundry.

In some cases, laundry may include shoes, which may be difficult for a user to manage. For example, shoes may be relatively dirty among other laundry, and thus a thorough hygiene management may be necessary. In some cases, it is inconvenient for a user to frequently wash the shoes, for example, by washing the shoes one by one with a washing brush.

SUMMARY

The present disclosure describes a machine for managing laundry that includes a washing part configured to accommodate shoes and perform washing of the shoes.

The present disclosure describes a machine for managing laundry that includes a shoe mount configured to stably support shoes within a tub.

The present disclosure describes a machine for managing laundry that includes at least three washing parts in one machine for managing laundry so that normal laundry, a small amount of laundry, and shoes are washed separately or at once.

The present disclosure describes a machine for managing laundry that includes three washing parts that are stacked in a vertical direction. In some examples, a first washing part, which generates relatively large vibration, may be disposed at a central portion so that the vibration generated in the machine for managing the laundry may be vertically balanced.

In some implementations, a machine for managing laundry may include at least three or more washing parts, which may be selectively driven for each washing capacity.

The at least three or more washing parts may be vertically stacked to improve user's accessibility and use convenience.

A washing space in which shoes are washed may be provided in one washing part of the at least three or more washing parts, and thus, it may be unnecessary to provide a separate washing machine for washing the shoes.

According to one aspect of the subject matter described in this application, a machine for managing laundry includes a first washing part including a first washing body and a first door, where the first washing part has a first washing capacity, a second washing part including a second washing body and a second door, where the second washing part has a second washing capacity that is less than the first washing capacity, and a third washing part including a third washing body and a third door, where the third washing part has a third washing capacity that is less than the first washing capacity. The third washing part includes a shoe mount configured to support one or more shoes. The first washing part, the second washing part, and the third washing part are configured to be stacked in a vertical direction.

Implementations according to this aspect may include one or more of the following features. For example, the third washing part may be disposed vertically above the first washing part, and the second washing part may be disposed vertically below the first washing part. In some examples, the third door may be coupled to the third washing body and configured to rotate upward relative to the third washing body. In some examples, the second washing body may be configured to be withdrawn forward of the first washing body, and the second door may be coupled to the second washing body and configured to rotate upward relative to the second washing body.

In some implementations, the third washing part may further include a tub rotatably disposed in the third washing body, and the shoe mount may be coupled to a lower portion of the tub. In some examples, the shoe mount may include a rotation plate coupled to a bottom surface of the tub, and a mounting protrusion that protrudes upward from the rotation plate and that is configured to support the one or more shoes. In some examples, the mounting protrusion may include an insertion protrusion configured to be inserted into the one or more shoes, and a support protrusion spaced apart from the insertion protrusion and configured to support a lateral surface of the one or more shoes.

In some implementations, the insertion protrusion may include a first insertion protrusion configured to be inserted into a first shoe of a pair of shoes and a second insertion protrusion configured to be inserted into a second shoe of the pair of shoes. In the same or other implementations, the support protrusion may include a first support protrusion configured to support a lateral surface of the first shoe and a second support protrusion configured to support a lateral surface of the second shoe. In some examples, the first insertion protrusion and the first support protrusion may be arranged along a first direction, and the second insertion protrusion and the second support protrusion may be arranged along a second direction that is opposite to the first direction.

In some implementations, the support protrusion may include a support surface having a bent or curved shape. In some examples, the support protrusion further may include a washing brush that protrudes from the support surface.

In some implementations, the third washing part may be disposed vertically below the first washing part, and the second washing part may be disposed vertically below the third washing part. In some implementations, the second washing part is disposed vertically below the first washing part, and the third washing part may be disposed vertically below the second washing part.

In some implementations, the shoe mount may include a plurality of shoe mounts configured to support a plurality of shoes. In some examples, the plurality of shoe mounts may be arranged about a center of a bottom surface of the third washing body. In some examples, each of the plurality of shoe mounts may include an insertion protrusion configured to insert into one of the plurality of shoes, and a support protrusion spaced apart from the insertion protrusion and configured to support a lateral surface of the one of the plurality of shoes.

In some examples, the rotation plate of the shoe mount may be configured to rotate about a center of the bottom surface of the tub. In some implementations, the third door may be coupled to an upper surface of the third washing body and configured to rotate upward relative to the upper surface of the third washing body. In some implementations, the third washing part may be disposed vertically below the first washing part or the second washing part in the vertical direction, where the third washing body may be configured to be withdrawn forward of the first washing part or the second washing part. The third door may be coupled to the third washing body and configured to rotate upward relative to the third washing body.

In some implementations, a height of each of the second washing part and the third washing part may be less than a height of the first washing part in the vertical direction.

The details of one or more implementations are set forth in the accompanying drawings and the description below. Other features will be apparent from the description and drawings, and from the claims.

DETAILED DESCRIPTION

Hereinafter, exemplary implementations will be described with reference to the accompanying drawings. The present disclosure may, however, be implemented in many different forms and should not be construed as being limited to the implementations set forth herein; rather, that alternate implementations included in other retrogressive disclosures or falling within the spirit and scope of the present disclosure will fully convey the concept of the disclosure to those skilled in the art.

Figure 1:
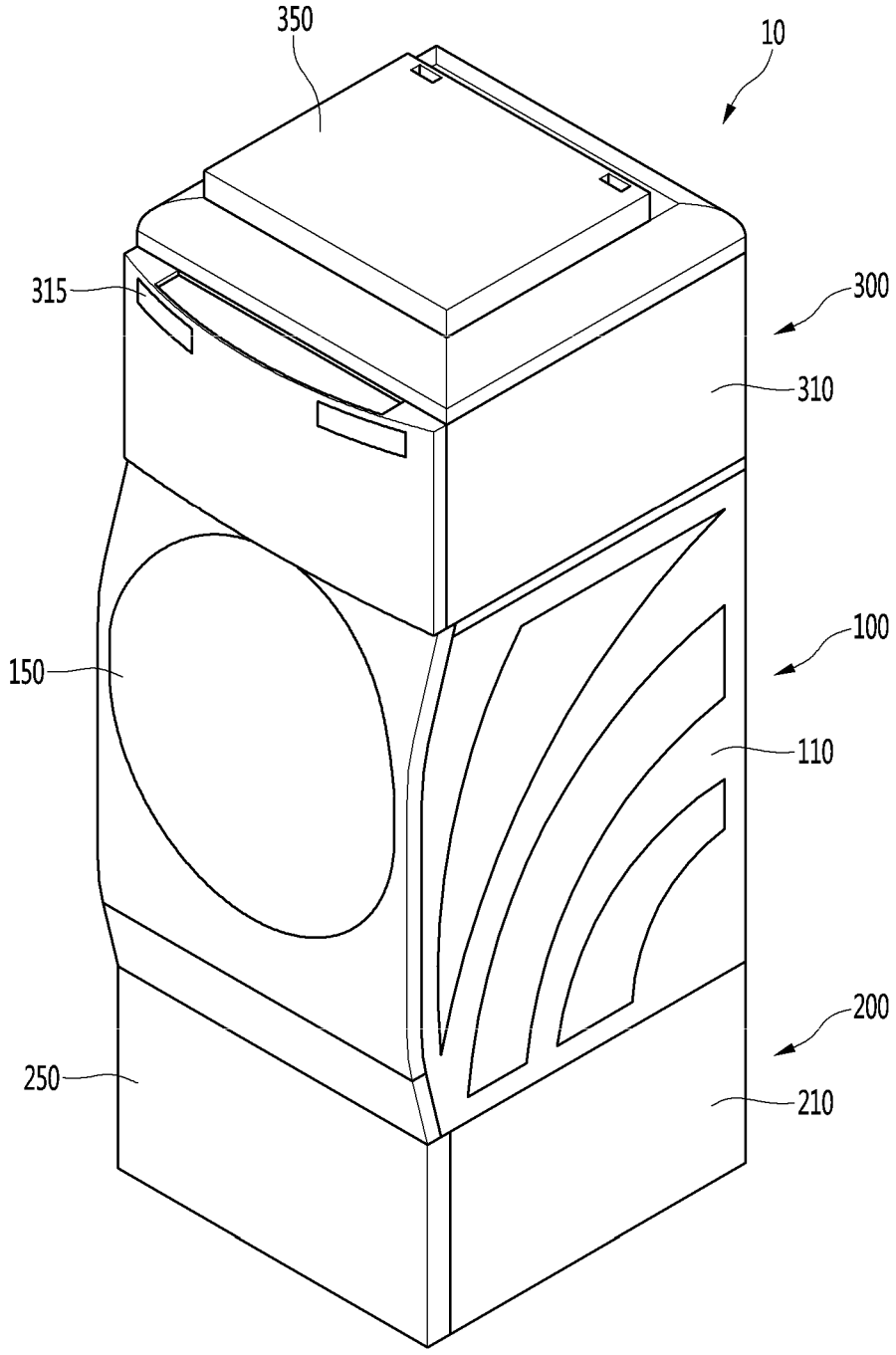
FIG. 1 is a perspective view illustrating an example machine for managing laundry.

FIG. 1 is a perspective view illustrating an example machine for managing laundry according to a first implementation.

Referring to FIG. 1, a machine 10 for managing laundry includes a plurality of washing parts 100, 200, and 300 that are configured to perform washing of laundry. The plurality of washing parts 100, 200, and 300 include a first washing part 100, a second washing part 200, and a third washing part 300, which are configured to be vertically stacked. For example, the second washing part 200 and the third washing part 300 may be stacked vertically above or below the first washing part 100. The first washing part 100 may have a washing capacity greater than that of the second washing part 200 or the third washing part 300. Here, the "washing capacity" may be understood as a capacity of a water storage tank containing water or a capacity of a tub which is rotatably provided inside the water storage tank and into which the laundry is put.

The first washing part 100, the second washing part 200, and the third washing part 300 may be configured to be coupled to or separated from one another. In some implementations, each of the first to third washing parts 100, 200, and 300 may include a water storage tank containing water, a tub configured to accommodate laundry and rotatably disposed within the water storage tank, a motor rotating the tub, a water supply device configured to supply water into the water storage tank or the tub, and a drain device configured to drain water within the water storage tank. Here, the above-described components may mutually and independently perform the washing. For instance, the second washing part 200 and the third washing part 300 may operate regardless of operation of the first washing part 100. The third washing part 300 may operate regardless of operation of the first washing part 100 or the second washing part 200. The first to third washing parts 100, 200, and 300 may operate simultaneously or finish operations at different times.

The first washing part 100 may have a washing part having a relatively large washing capacity (size), and each of the second and third washing parts 200 and 300 may have a washing capacity (size) less than that of the first washing part 100.

For example, a first tub rotatably provided in the first washing part 100 may have a size greater than that of a second tub rotatably provided in the second washing part 100 or a third tub 330 (see FIG. 3) rotatably provided in the third washing part 300.

In some cases, vibration of a motor for rotating the first tub may be greater than of a motor for rotating the second tub or a motor for rotating the third tub.

In some implementations, the first washing part 100 may be disposed between the second washing part 200 and the third washing part 300 with respect to a vertical direction. For example, as illustrated in FIG. 1, the second washing part 200 may be disposed below the first washing part 100, and the third washing part 300 may be disposed above the first washing part 100.

The vibration generated in the first washing part 100 may be transmitted upward and downward through the second washing part 200 and the third washing part 300. Thus, in the entire machine 10 for managing the laundry, the vibration may be balanced in the vertical direction. In some examples, the second washing part 200 may be placed on the bottom. Here, the vibration of the machine 10 for managing the laundry may be prevented from being transmitted to the bottom. For instance, the vibration transferred to the bottom of the machine 10 may be reduced as the second washing part 200 may absorb or block some of the vibration from the first washing part 100 or the third washing part 300.

The first washing part 100 includes a first washing body 110 including the water storage tank, and a first door 150 configured to open and close a front portion of the first washing body 110. The first door 150 may be hinge-coupled to the first washing body 110 and configured to rotate forward of the first washing body 110.

When the first door 150 is opened, the laundry may be put from a front side of the first side of the first washing part 100 to the inside of the first washing body 110. Thus, the first washing part 100 may be understood as a front load type washing part. The first washing part 100 may be used when laundry having a relatively large volume or a relatively large amount of laundry needs to be washed at once.

The second washing part 200 include a cabinet 210 and a second washing body 250 that is configured to be withdrawn forward from the cabinet 210 and that includes a water storage tank. When the second washing body 250 is withdrawn forward, an upper end of the second washing body 250 may be exposed. Thus, a second door may be provided on an upper portion of the second washing body 250.

The second door may be rotated upward to be opened. As a result, the laundry may be put from an upper side of the second washing body 250 to the inside of the second washing body 250. Thus, the second washing part 200 may be understood as a top load type washing part. The second washing part 200 may be used when laundry having a relatively small volume or sensitive laundry that requires hand-washing needs to be separately washed.

The third washing part 300 includes a third washing body 310 that includes a water storage tank, and a third door 350 configured to open and close on an upper portion of the third washing body 310.

In some implementations, the third washing part 300 may include a detergent feeding part 315 having a detergent feeding space that is configured to receive detergent and that is defined in a front portion of the third washing body 310. The detergent feeding part 315 may be withdrawn forward to expose the detergent feeding space. The detergent feeding part 315 may be provided in plurality. For example, a normal detergent may be put into one detergent feeding part 315, and a softener may be put into the other detergent feeding part 315.

The third door 350 may be hinge-coupled to the third washing body 310 and configured to rotate upward relative to the third washing body 310. The laundry may be put from an upper side of the third washing body 310 to the inside of the third washing body 310. Thus, the third washing part 300 may be understood as a top load type washing part. The third washing part 300 may be understood as a "shoe washing part" into which shoes are put to be washed.

Figure 2:
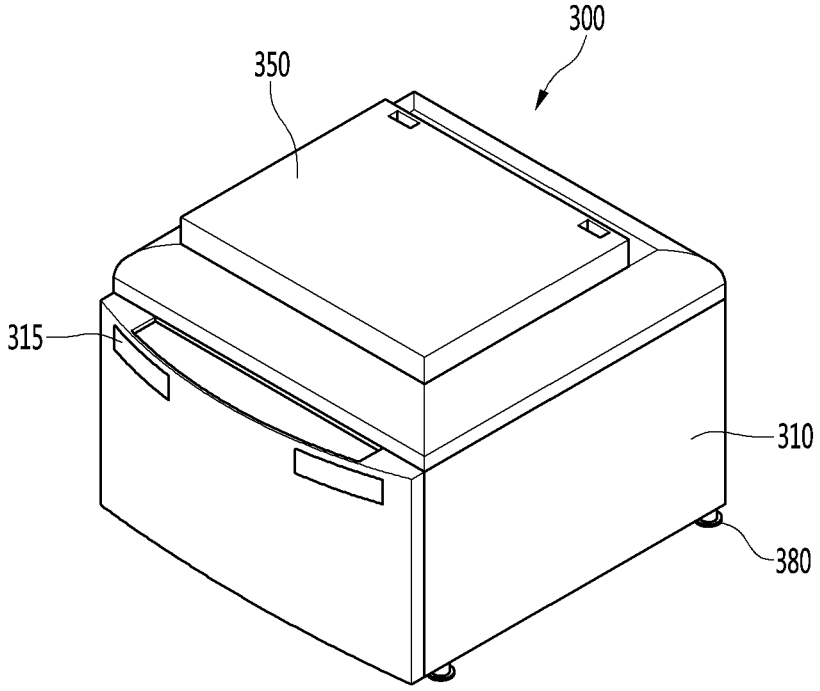
FIG. 2 is a perspective view illustrating an example third washing part.
Figure 3:
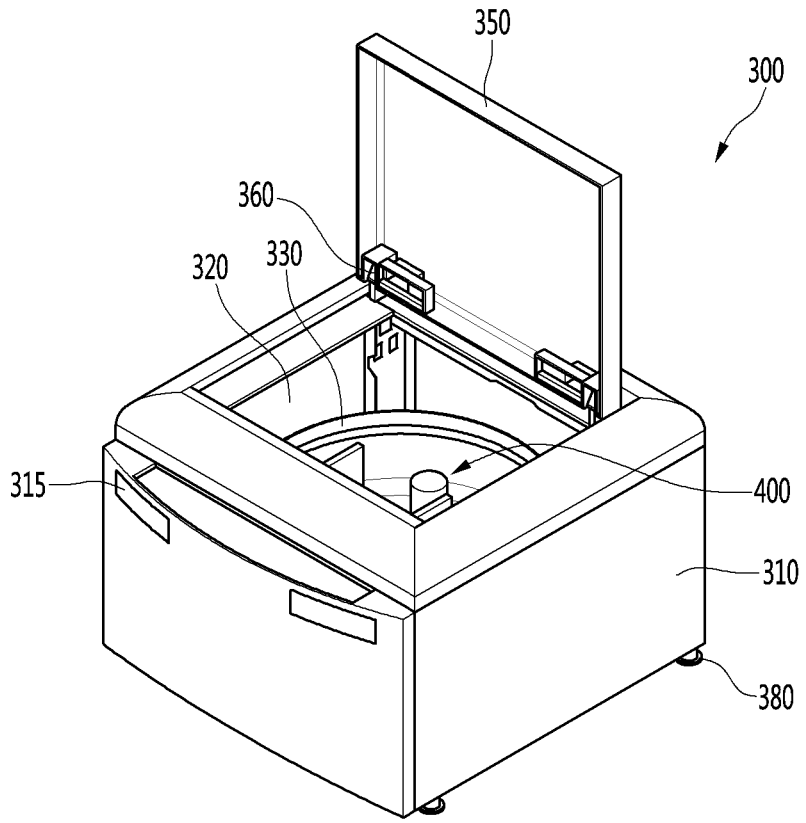
FIG. 3 is a perspective view illustrating an example state in which an example door of the third washing part is opened.
Figure 4:
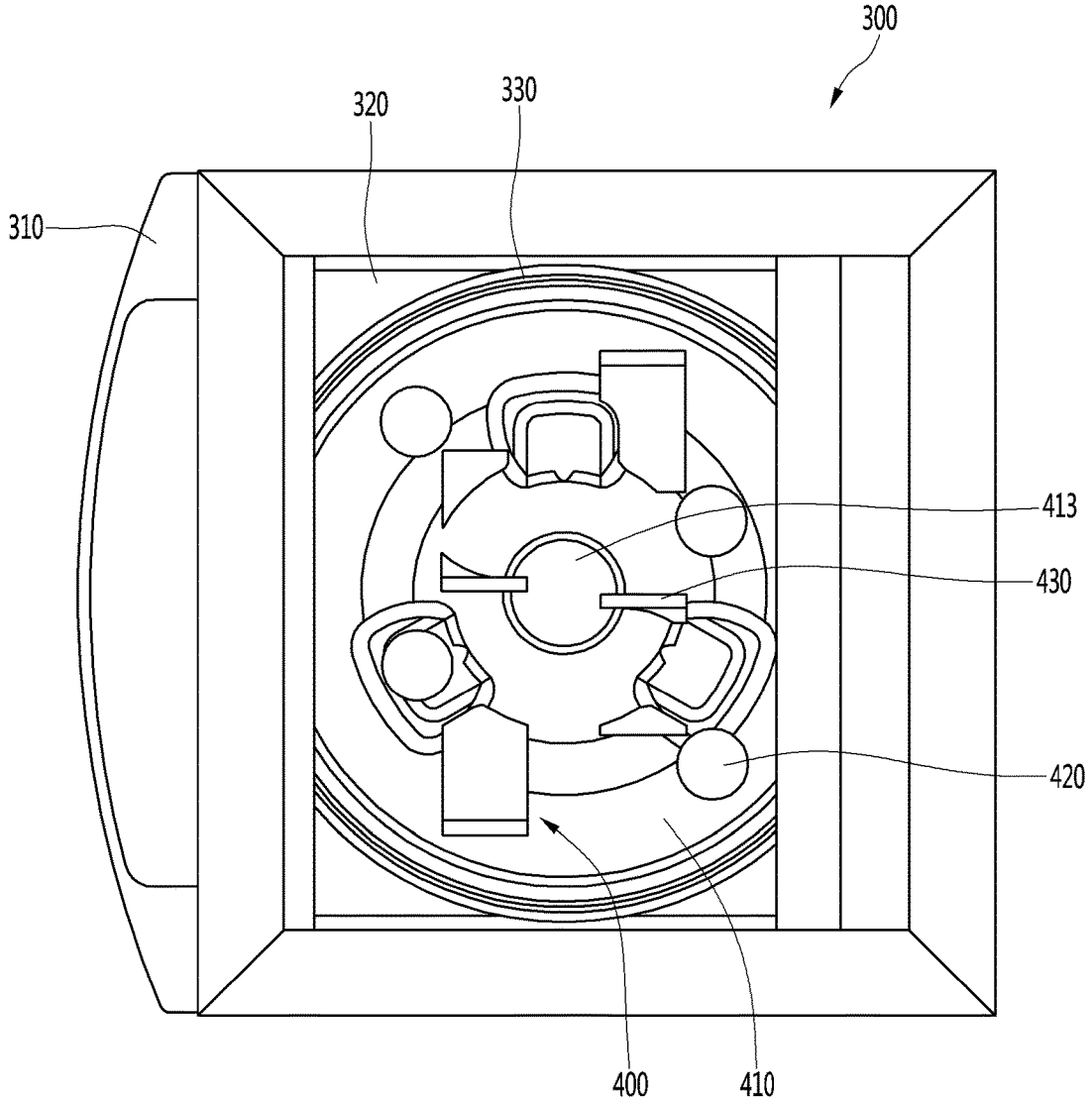
FIG. 4 is a plan view illustrating an example inside of the third washing part.

FIG. 2 is a perspective view illustrating an example configuration of the third washing part according to the first implementation, FIG. 3 is a perspective view illustrating an example state in which the door of the third washing part is opened according to the first implementation, and FIG. 4 is a plan view illustrating an example inside of the third washing part according to the first implementation.

Referring to FIGS. 2 to 4, the third washing part 300 according to the first implementation is installed above the first washing part 100. A mount 380 placed on a top surface of the first washing part 100 is disposed on a lower portion of the third washing part 300. The mount 380 may be provided in plurality.

The third washing part 300 may have an approximately rectangular parallelepiped shape, and the plurality of mounts 380 may be disposed on four corners of the third washing part 300. Also, the plurality of mounts 380 may be supported by a top surface of the first washing part 100.

The third door 350 of the third washing part 300 may be provided so that a front portion of the third door 350 is rotatable upward about a rear portion to open and close the opening 311 of the third washing body 310. The opening 311 may be defined to be opened in an upper portion of the third washing body 310.

A hinge part 360 providing a rotational center of the third door 350 is disposed at a rear portion of the third washing part 300. A hinge haft may be provided in the hinge part 360. The hinge shaft may be coupled to the third door 350 and one side of the opening 311 of the third washing body 310. The hinge shaft may be provided in plurality on both sides of the opening 311.

A water storage tank 320 containing water is provided in the third washing body 310. Also, a tub 330 accommodating the laundry and rotatably provided within the water storage tank 320 is installed inside the water storage tank 320. The tub 330 may have a cylindrical shape with an upper portion opened. A plurality of through-holes through which water passes may be defined in the tub 330.

A shoe mount 400 for mounting one or more shoes may be installed in the tub 330. The shoe mount 400 may be coupled to a bottom surface of the tub 330 so as to be rotated together with the tub 330. For example, a shoe S may be mounted on the shoe mount 400. The shoe S may be soaked by water in which the detergent is dissolved and then washed by frictional force with the water while the tub 330 is rotated.

The shoe mount 400 includes a rotation plate 410 having a disk shape and a plurality of protrusions 420 and 430 protruding upward from the rotation plate 410 to mount or support the shoe S.

The rotation plate 410 is coupled to a bottom surface of the tub 30 so as to be rotated, and a rotational central portion 413 is defined at a central portion of the rotation plate 410. The rotation plate 410 may be rotated about the rotational central portion 413.

In some implementations, the plurality of protrusions 420 and 430 may be disposed at positions that are spaced apart from each other in a radial direction with respect to the rotational central portion 413. Thus, centrifugal force may be applied to the shoe S supported by the protrusions 420 and 430 during the rotation of the rotation plate 410. As a result, the shoe S may be dehydrated.

The plurality of protrusions 420 and 430 include a plurality of insertion protrusions 420 inserted into the shoe S and a plurality of support protrusions 430 supporting a lateral surface of the shoe S. The plurality of protrusions 420 and 430 will be described below with reference to the accompanying drawings.

Figure 5:
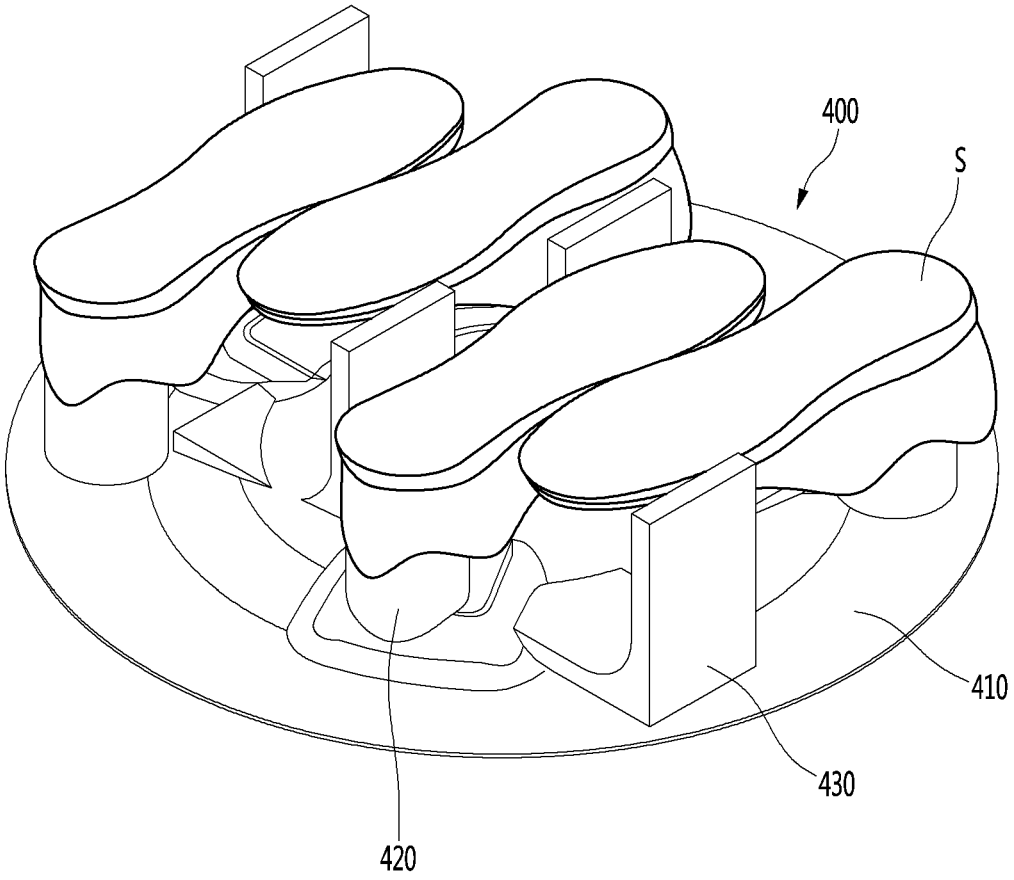
FIG. 5 is a perspective view illustrating an example state in which a shoe S is mounted on an example shoe mount.
Figure 6:
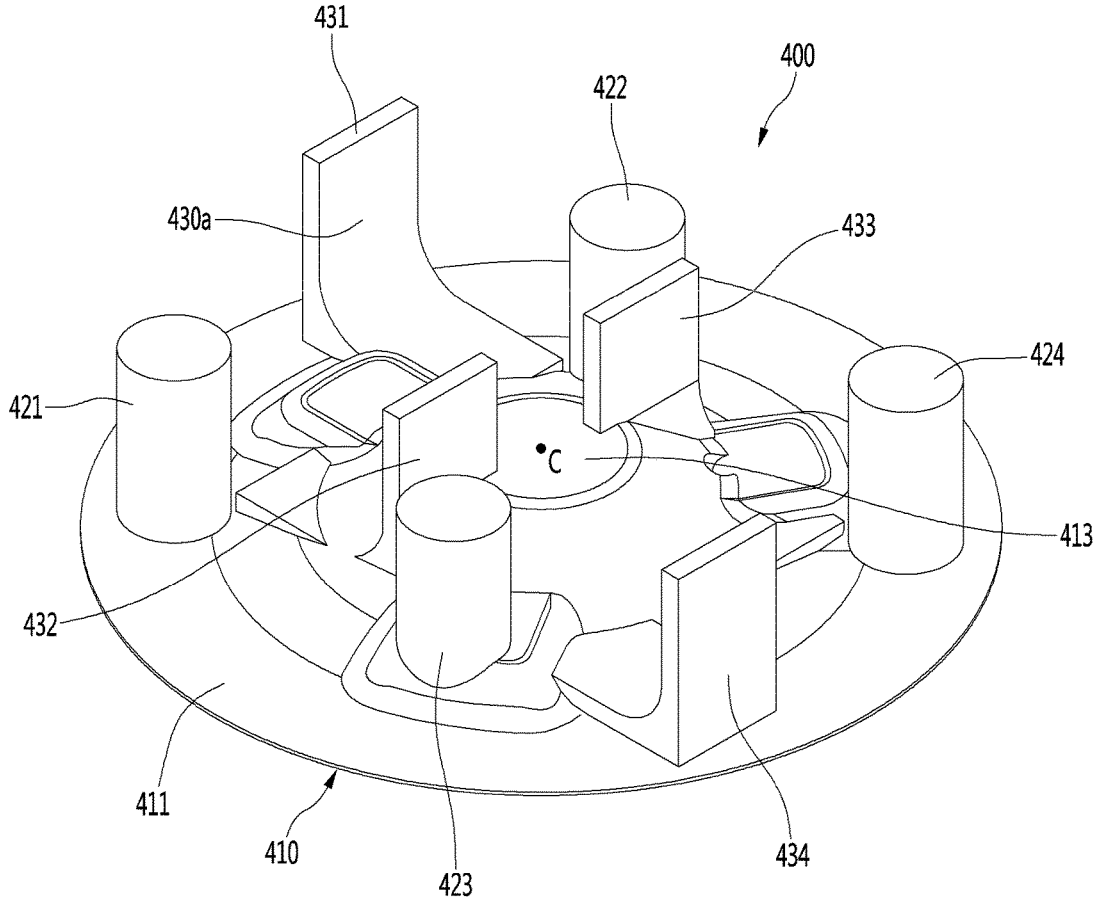
FIG. 6 is a view illustrating an example configuration of the shoe mount.
Figure 7:
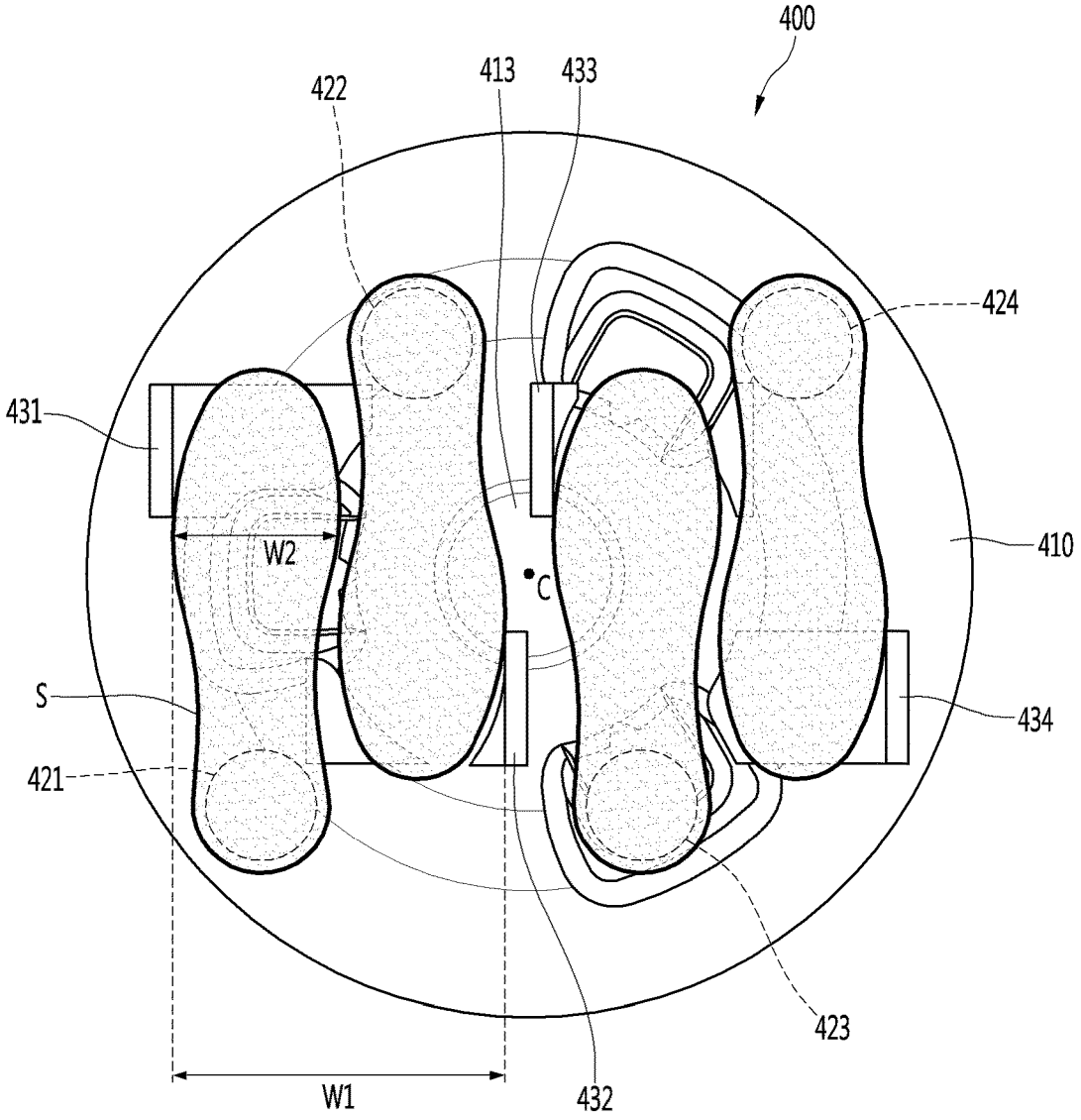
FIG. 7 is a plan view illustrating an example state in which the shoe S is mounted on the shoe mount.

FIG. 5 is a perspective view illustrating an example state in which the shoe S is mounted on the shoe mount according to the first implementation, FIG. 6 is a view illustrating an example configuration of the shoe mount according to the first implementation, and FIG. 7 is a plan view illustrating an example state in which the shoe S is mounted on the shoe mount according to the first implementation.

Referring to FIGS. 5 to 7, the shoe mount 400 according to the first implementation includes the rotation plate 410 accommodated in the tub 330 and coupled to the bottom surface of the tub 330, the plurality of insertion protrusions 420 protruding upward from different points of the rotation plate 410, and the plurality of support protrusions 430 spaced apart from the plurality of insertion protrusions 420 to protrude upward.

Each of the insertion protrusions 420 may have a cylindrical or polygonal column shape. The insertion protrusions 420 may be disposed to be inserted into the shoe S. That is, the shoe S may be disposed so that a bottom surface of the shoe Sis turned upside down to allow the insertion protrusion 420 to be inserted.

For example, the plurality of insertion protrusions 420 include a first insertion protrusion 421, a second insertion protrusion 422, a third insertion protrusion 423, and a fourth insertion protrusion 424, which are disposed to be spaced apart from each other. Since the four insertion protrusions 421, 422, 423, and 424 are respectively inserted into the shoes S, two pairs of shoes S may be mounted by the four insertion protrusions 421, 422, 423, and 424.

Each of the support protrusion 430 may be spaced apart from the insertion protrusion 420 to protrude upward from the rotation plate 410. Also, the support protrusion 430 may have a bent or curved shape. For example, the support protrusion 430 may be bent in an "L" shape. A bent one surface of the support protrusion 430 may define a support surface 430*a*, and the support surface 430*a* may be configured to support a lateral surface of the shoe S.

The plurality of support protrusions 430 include a first support protrusion 431, a second support protrusion 432, a third support protrusion 433, and a fourth support protrusion 434, which are disposed to be spaced apart from each other. The four support protrusions 431, 432, 433, and 434 may be disposed to correspond to the four insertion protrusions 421, 422, 423, and 424, respectively. The lateral surfaces of the two pairs of shoes S may be supported by the four support protrusions 431, 432, 433, and 434.

One shoe of the pair of shoes S may be supported by the first insertion protrusion 421 and the first support protrusion 431. Also, the other shoe of the pair of shoes S may be supported by the second insertion protrusion 422 and the second support protrusion 432. A direction directed from the first insertion protrusion 421 toward the first support protrusion 431 and a direction directed from the second insertion protrusion 422 toward the second support protrusion 432 may be opposite to each other. Due to the above-described arrangement, the directions in which the pair of shoes S are supported may be directions facing each other to improve the space utilization of the shoe mount 400.

One shoe of the other pair of shoes S may be supported by the third insertion protrusion 423 and the third support protrusion 433. Also, the other shoe of the other pair of shoes S may be supported by the fourth insertion protrusion 424 and the fourth support protrusion 434. A direction directed from the third insertion protrusion 423 toward the third support protrusion 433 and a direction directed from the fourth insertion protrusion 424 toward the fourth support protrusion 434 may be opposite to each other. Due to the above-described arrangement, the directions in which the other pair of shoes S are supported may be directions facing each other to improve the space utilization of the shoe mount 400.

The second support protrusion 432 and the third support protrusion 433 may be disposed on the rotational central portion 413, and the first and second insertion protrusions 421 and 422 and the third and fourth insertion protrusions 423 and 424 may be respectively disposed on both sides of the second and third support protrusions 432 and 433.

A distance W1 between the first support protrusion 431 and the second support protrusion 432 may be slightly greater than a left/right width W2 of the shoe S1. The left/right width W2 of the shoe S1 may be different according to a kind or size of shoe S. In some examples, where the difference in width is not so much, the left/right width W2 may be understood as a left/right width W2 of a general shoe S1 of adults.

Due this configuration, when the pair of shoes S are disposed in a space between the first and second support protrusions 431 and 432, both lateral surfaces of the pair of shoes S may be firmly supported by the first and second support protrusions 431 and 432. In some cases, the left/right width W2, the distance W1, or both may be variable according to a size of the shoe S1.

Similarly, description with respect to a distance between the third support protrusion 433 and the fourth support protrusion 434 will be derived from the above-described description.

Figure 8:
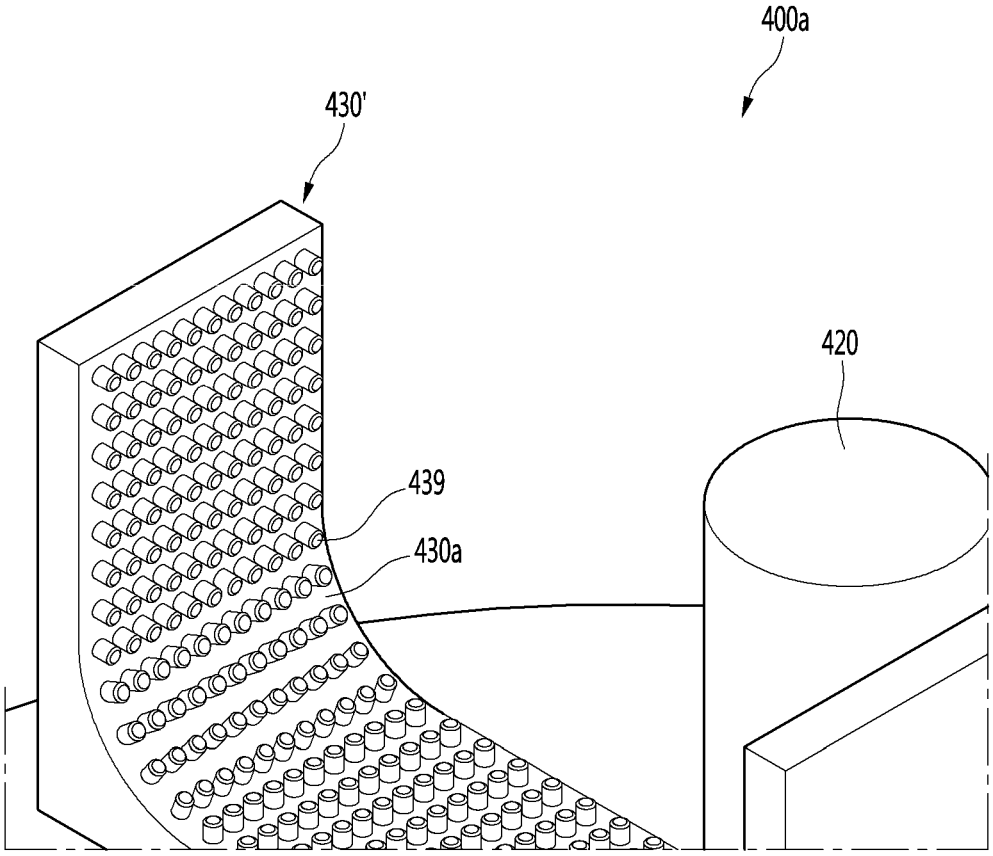
FIG. 8 is a view illustrating example components of another example shoe mount.

FIG. 8 is a view illustrating example components of an example shoe mount according to a second implementation.

Referring to FIG. 8, a shoe mount 400*a* according to a second implementation includes a support protrusion 430' provided with a washing brush 439. In the support protrusion 430', a support surface 430*a* on which a lateral surface of a shoe S is supported may be bent or curved to extend. A washing brush 439 brushing an outer surface of the shoe S may be disposed on the support surface 430*a*. The washing brush 439 may include a plurality of bristles.

The washing brush 439 may have a projection shape to protrude from the support surface 430*a*. While the shoe mount 400*a* is rotated, relative movement between the support protrusion 430' and the shoe S may occur. In this process, the washing brush 439 may be rubbed with the outer surface of the shoe S to perform the brushing on the shoe S. Due to this configuration, the washing of the shoe S may be improved.

Hereinafter, a description will be made according to third and fourth implementations. The third and fourth implementations mainly focus on differences in arrangement of the plurality of washing parts, and descriptions of the same parts will be denoted by the same reference numerals and descriptions of the first implementation.

Figure 9:
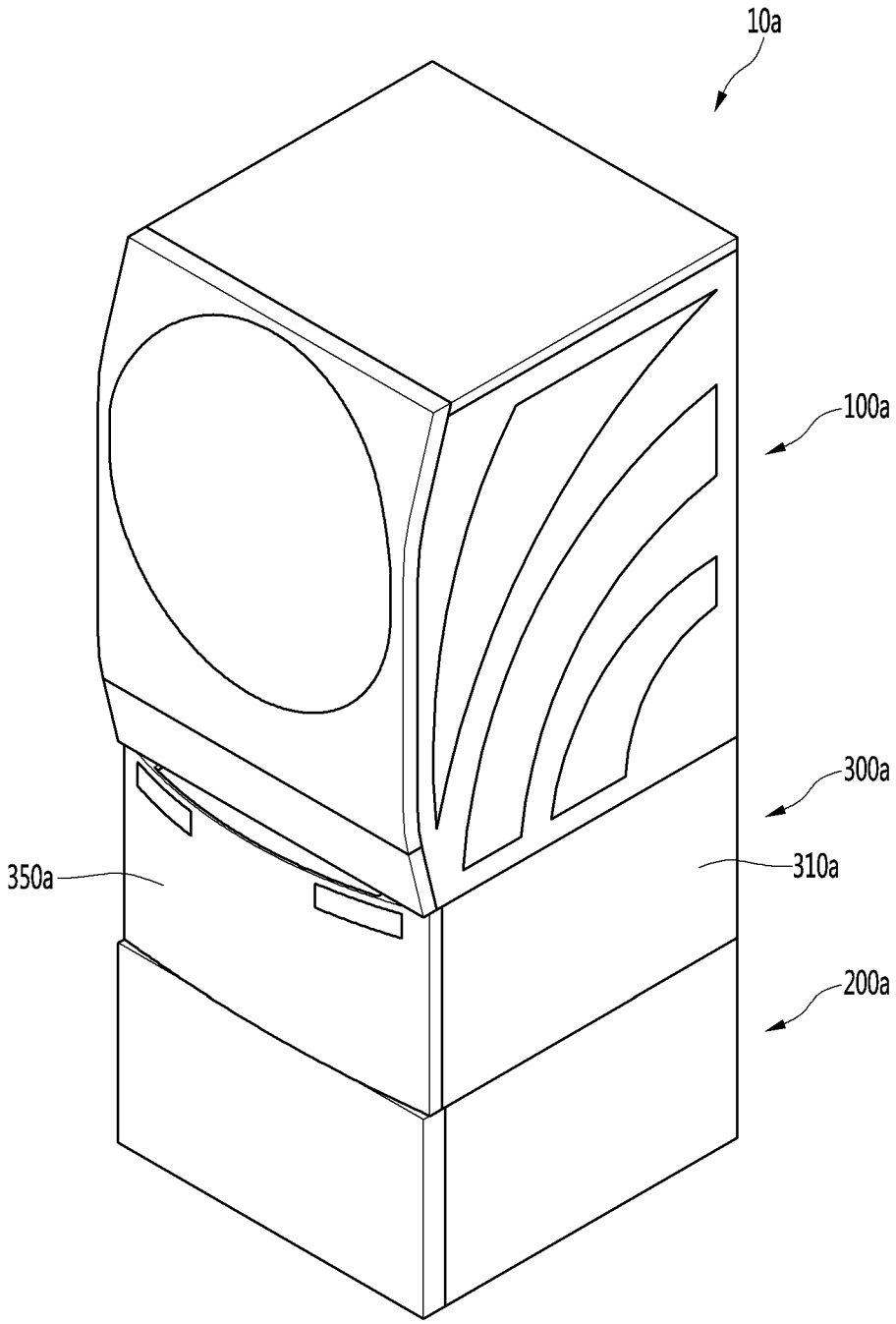
FIG. 9 is a perspective view illustrating another example machine for managing laundry.

FIG. 9 is a perspective view illustrating an example machine for managing laundry according to a third implementation.

Referring to FIG. 9, in a machine 10*a* for managing laundry according to a third implementation, a third washing part 300*a* may be disposed between the first washing part 100*a* and the second washing part 200*a*. Each of the first and second washing parts 100*a* and 200*a* may have the same configuration as that of each of the first and second washing parts 100 and 200 according to the first implementation.

The third washing part 300*a* may include a cabinet 310*a* and a third washing body 350*a* that is withdrawn forward from the cabinet 310*a*. This structure may be the same as that of the second washing part 200 according to the first implementation. That is, when the third washing body 350*a* is withdrawn, an upper end of the third washing body 350*a* may be exposed, and thus, a third door that is openable may be disposed on an upper portion of the third washing body 350*a*. When the third door is opened, a shoe S may be put.

According to this configuration, the first washing part 100*a* generating relatively large vibration may constitute an upper portion of the machine 10*a* for managing laundry, and the second and third washing parts 200*a* and 300*a* may be disposed below the first washing part 100*a* to reduce vibration of the first washing part 100*a* transmitted to a bottom surface of the machine 10*a* for managing the laundry. That is, the second and third washing parts 200*a* and 300*a* may serve as buffers that reduce the vibration.

Figure 10:
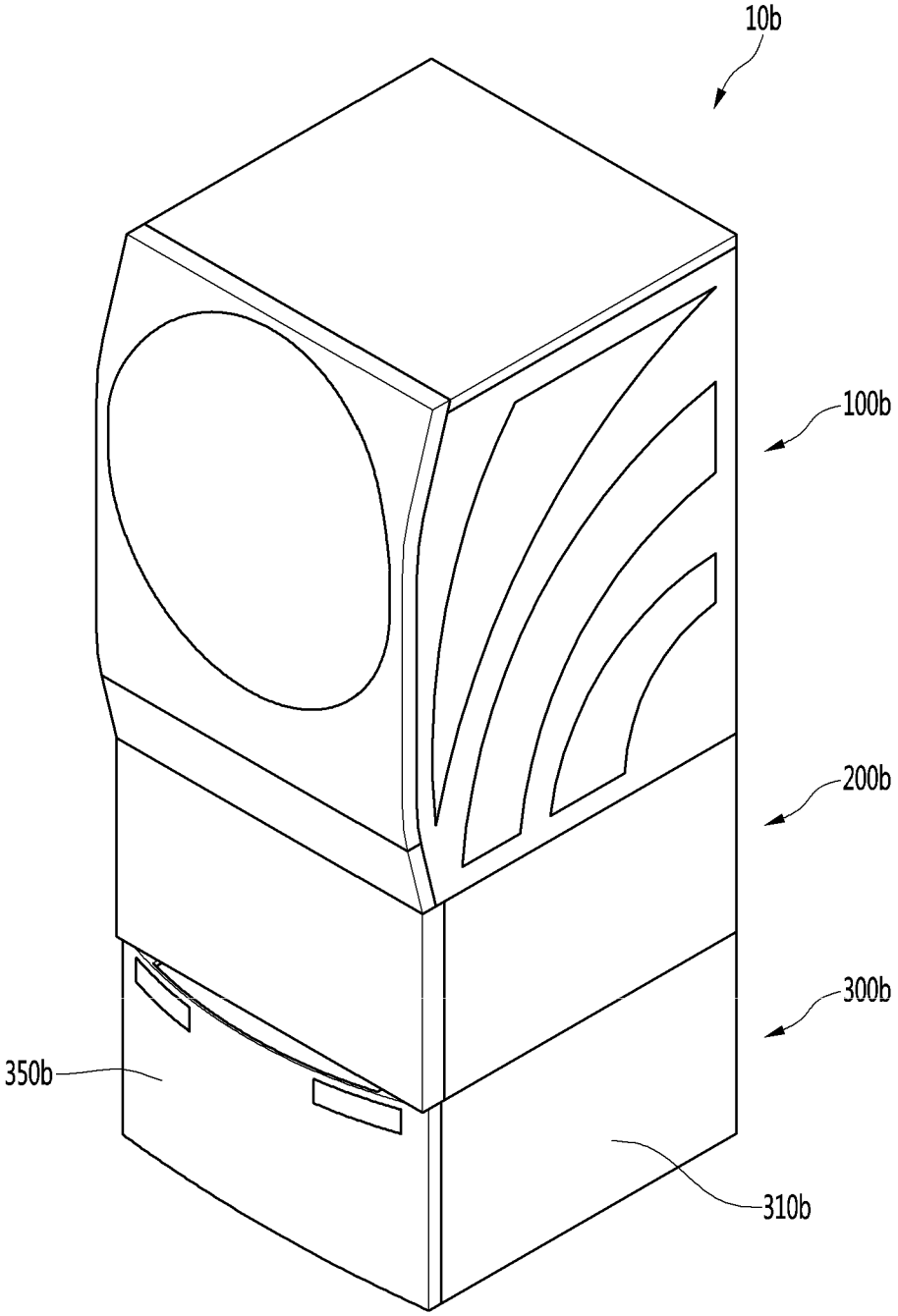
FIG. 10 is a perspective view illustrating another example machine for managing laundry.

FIG. 10 is a perspective view illustrating an example machine for managing laundry according to a fourth implementation.

Referring to FIG. 10, in a machine 10*b* for managing laundry according to a fourth implementation, a first washing part 100*b* is disposed at the uppermost position, and a third washing part 300*b* may be disposed below a second washing part 200*b*. Each of the first and second washing parts 100*b* and 200*b* may have the same configuration as that of each of the first and second washing parts 100 and 200 according to the first implementation.

The third washing part 300*b* may include a cabinet 310*b* and a third washing body 350*b* that is withdrawn forward from the cabinet 310*b*. This structure may be the same as that of the second washing part 200 according to the first implementation. That is, when the third washing body 350*b* is withdrawn, an upper end of the third washing body 350*b* may be exposed, and thus, a third door that is openable may be disposed on an upper portion of the third washing body 350*b*. When the third door is opened, a shoe S may be put.

According to this configuration, the first washing part 100*b* generating relatively large vibration may constitute an upper portion of the machine 10*a* for managing laundry, and the second and third washing parts 200*b* and 300*b* may be disposed below the first washing part 100*b* to reduce vibration of the first washing part 100*b* transmitted to a bottom surface of the machine 10*b* for managing the laundry. That is, the second and third washing parts 200*b* and 300*b* may serve as buffers that reduce the vibration.

In some implementations, since the washing part accommodating the shoes is separately provided in the machine for managing the laundry, the shoes may be easily washed.

In some implementations, since the insertion protrusion inserted into the shoe and the support protrusion supporting the lateral surface of the shoe may be provided to support the shoes, the shoes may be prevented from being separated from the tub in which the shoes rotate.

In some implementations, the at least three washing parts may be provided in one machine for managing laundry so that normal laundry, a small amount of laundry, and shoes are washed separately or at once, thereby easily managing the laundry.

In some implementations, the three washing parts may be vertically stacked so that the plurality of washing parts are efficiently disposed to improve the space utilization.

In some implementations, the first washing part generating the relatively largest vibration may be disposed at the central portion, and the second and third washing parts generating the relatively small vibration may be disposed above and below the first washing part so that the vibration generated in the machine for managing the laundry is vertically balanced.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A machine for managing laundry, comprising:

a first washing part comprising a first washing body and a first door, the first washing part having a first washing capacity;

a second washing part comprising a second washing body and a second door, the second washing part having a second washing capacity that is less than the first washing capacity; and a third washing part comprising a third washing body and a third door, the third washing part having a third washing capacity that is less than the first washing capacity, wherein the third washing part comprises a tub rotatably disposed in the third washing body and a shoe mount configured to support a pair of shoes, the pair of shoes including a first shoe and a second shoe, wherein the shoe mount comprises:

a rotation plate disposed at a bottom surface of the tub, and a plurality of mounting protrusions configured to support the pair of shoes, the plurality of mounting protrusions comprising:

a pair of insertion protrusions that protrude upward from the rotation plate, the pair of insertion protrusions including a first protrusion configured to be inserted into a heel of the first shoe and a second protrusion configured to be inserted into a heel of the second shoe, and a pair of support protrusions that protrude from the rotation plate, the pair of support protrusions including a third protrusion configured to contact a laterally outer surface of a toe of the first shoe and a fourth protrusion configured to contact a laterally outer surface of a toe of the second shoe, wherein the first protrusion and the third protrusion define a first mount array configured to support the first shoe horizontally, and the second protrusion and the fourth protrusion define a second mount array configured to support the second shoe horizontally, and wherein (i) the second protrusion and the third protrusion are spaced apart from each other in a horizontal direction such that the toe of the first shoe is disposed adjacent to the heel of the second shoe, or (ii) the first protrusion and the fourth protrusion are spaced apart from each other in the horizontal direction such that the heel of the first shoe is disposed adjacent to the toe of the second shoe.

2. The machine according to claim 1, wherein the first washing part, the second washing part, and the third washing part are configured to be stacked in a vertical direction, wherein the third washing part is disposed vertically above the first washing part, and wherein the second washing part is disposed vertically below the first washing part.

3. The machine according to claim 2, wherein the third door is coupled to the third washing body and configured to rotate upward relative to the third washing body.

4. The machine according to claim 2, wherein the second washing body is configured to be withdrawn forward of the first washing body, and wherein the second door is coupled to the second washing body and configured to rotate upward relative to the second washing body.

5. The machine according to claim 2, wherein a height of each of the second washing part and the third washing part is less than a height of the first washing part in the vertical direction.

6. The machine according to claim 1, wherein each of the pair of insertion protrusions has a cylindrical or polygonal column shape extending upward from the rotation plate.

7. The machine according to claim 6, wherein at least one of the pair of support protrusions has a plate shape that extends from the rotation plate.

8. The machine according to claim 6, wherein at least one of the pair of support protrusions has a curved plate shape that extends along the rotation plate and upward from the rotation plate.

9. The machine according to claim 1, wherein the first protrusion and the third protrusion are arranged along a first direction parallel to the rotation plate, the first direction being oriented from the first protrusion to the third protrusion, and wherein the second protrusion and the fourth protrusion are arranged along a second direction that is parallel to the rotation plate and opposite to the first direction, the second direction being oriented from the second protrusion to the fourth protrusion.

10. The machine according to claim 1, wherein at least one of the third protrusion or the fourth protrusion comprises a support surface having a bent or curved shape.

11. The machine according to claim 10, wherein at least one of the third protrusion or the fourth protrusion further comprises a washing brush that protrudes from the support surface.

12. The machine according to claim 1, wherein the third washing part is disposed vertically below the first washing part, and wherein the second washing part is disposed vertically below the third washing part.

13. The machine according to claim 1, wherein the second washing part is disposed vertically below the first washing part, and wherein the third washing part is disposed vertically below the second washing part.

14. The machine according to claim 1, wherein the plurality of mounting protrusions are arranged about a center of a bottom surface of the third washing body.

15. The machine according to claim 1, wherein the rotation plate of the shoe mount is configured to rotate about a center of the bottom surface of the tub.

16. The machine according to claim 1, wherein the third door is coupled to an upper surface of the third washing body and configured to rotate upward relative to the upper surface of the third washing body.

17. The machine according to claim 1, wherein the third washing part is disposed vertically below the first washing part or the second washing part in a vertical direction, wherein the third washing body is configured to be withdrawn forward of the first washing part or the second washing part, and wherein the third door is coupled to the third washing body and configured to rotate upward relative to the third washing body.

18. The machine according to claim 1, wherein the fourth protrusion is spaced apart from the second protrusion in a direction parallel to the rotation plate such that the second shoe is laid on the rotation plate, and wherein the plurality of mounting protrusions are configured to support the second shoe in a state in which the heel of the second shoe and the toe of the second shoe are arranged along the direction parallel to the rotation plate.

19. The machine according to claim 1, wherein the third protrusion is spaced apart from the first protrusion in a direction parallel to the rotation plate such that the first shoe is laid on the rotation plate, and wherein the plurality of mounting protrusions are configured to support the first shoe in a state in which the heel of the first shoe and the toe of the first shoe are arranged along the direction parallel to the rotation plate.

20. The machine according to claim 1, wherein the plurality of mounting protrusions are configured to support the first shoe and the second shoe horizontally such that the heel of the first shoe, the toe of the first shoe, the heel of the second shoe, and the toe of the second shoe are disposed on a common plane parallel to the rotation plate.

* * * * *